US010201741B1

(12) United States Patent
Dichard et al.

(10) Patent No.: US 10,201,741 B1
(45) Date of Patent: Feb. 12, 2019

(54) GOLF PUTTING TRAINER

(71) Applicant: Evolution Golf Products, LLC, Hudson, NH (US)

(72) Inventors: Seth Dichard, Hudson, NH (US); DeCarlo Rodriguez, Nashua, NH (US)

(73) Assignee: Evolution Golf Products, LLC, Hudson, NH (US)

( * ) Notice: Subject to any disclaimer, the term of this patent is extended or adjusted under 35 U.S.C. 154(b) by 0 days.

(21) Appl. No.: 15/285,209

(22) Filed: Oct. 4, 2016

Related U.S. Application Data

(60) Provisional application No. 62/237,431, filed on Oct. 5, 2015, provisional application No. 62/264,823, filed on Dec. 8, 2015.

(51) Int. Cl.
*A63B 69/36* (2006.01)

(52) U.S. Cl.
CPC .. *A63B 69/3676* (2013.01); *A63B 2208/0204* (2013.01)

(58) Field of Classification Search
CPC ..... A63B 69/3676; A63B 2208/0204
See application file for complete search history.

(56) References Cited

U.S. PATENT DOCUMENTS

| | | | | |
|---|---|---|---|---|
| 5,205,559 | A * | 4/1993 | Plopper | A63B 63/00 273/127 B |
| 5,415,397 | A * | 5/1995 | Van Holt, Jr. | A63B 57/40 473/179 |
| 2007/0099716 | A1* | 5/2007 | Du Plessis | A63B 57/40 473/179 |
| 2013/0035172 | A1* | 2/2013 | Woodhouse | A63B 69/3676 473/179 |
| 2013/0324273 | A1* | 12/2013 | Reino | A63B 69/3676 473/176 |

* cited by examiner

*Primary Examiner* — Michael D Dennis
(74) *Attorney, Agent, or Firm* — Cambridge Technology Law LLC; David E. Boundy

(57) ABSTRACT

A golf training device. A circular body has a rim designed to allow the training device to be inserted and held securely in a golf hole. A top surface is designed to cause a loss of momentum and/or energy and/or speed of a golf ball rolling across the top surface, the loss corresponding to a desired loss of roll distance of a golf ball. The rim and top surface are disposed in the training device to provide a putting training device designed to provide training feedback to a golfer to putt a ball at a desired speed.

18 Claims, 7 Drawing Sheets

GOLF PUTTING TRAINER

BACKGROUND

This application is a non prov. of provisional of U.S. Provisional Application Ser. No. 62/264,823, filed Dec. 8, 2015. This application is a non prov. of provisional of U.S. Provisional Application Ser. No. 62/237,431, filed Oct. 5, 2015. Both are incorporated by reference.

This application relates to a device for training of golf putting.

SUMMARY

In general, in a first aspect, the invention features a method. A golfer putts a golf ball toward a golf training device. The device is designed to provide training feedback to help the golfer to putt the golf ball at a desired speed. The device has a top surface designed to cause a loss of momentum and/or energy and/or speed of a golf ball rolling across the top surface. The loss corresponds to a desired loss of roll distance of a golf ball.

In general, in a second aspect, the invention features a golf training device. A circular body has a rim designed to allow the training device to be inserted and held securely in a golf hole 112. A top surface is designed to cause a loss of momentum and/or energy and/or speed of a golf ball rolling across the top surface, the loss corresponding to a desired loss of roll distance of a golf ball. The rim and top surface are disposed in the training device to provide a putting training device designed to provide training feedback to a golfer to putt a ball at a desired speed.

Embodiments of the invention may include one or more of the following features. The height and shape of a rim may be configured to impose a desired degree of loss. The device may be sold in a set of devices, configured to impose corresponding losses. The rim of the device may be designed to engage with a golf hole 112 at a desired depth. The rim may have spring features or taper features to hold the device in golf hole 112.

The above advantages and features are of representative embodiments only, and are presented only to assist in understanding the invention. It should be understood that they are not to be considered limitations on the invention as defined by the claims. Additional features and advantages of embodiments of the invention will become apparent in the following description, from the drawings, and from the claims.

DESCRIPTION

Figure 1A:
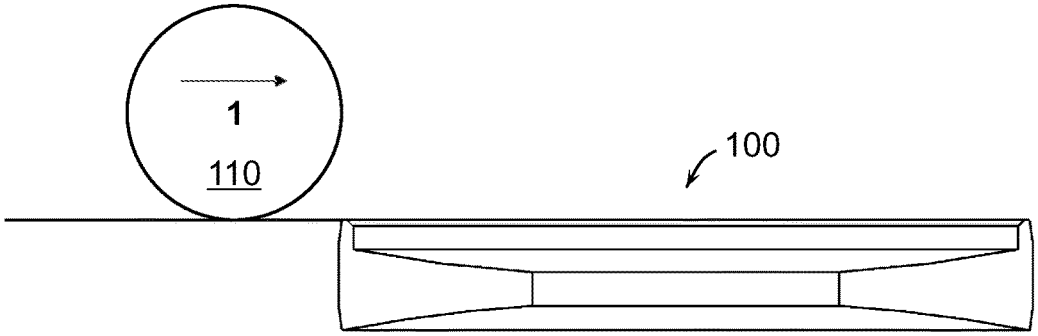
FIGS. 1A, 1B, 1C, 2A, 2B, 2C, 2E, 2F, and 3B are side section views.
Figure 1B:
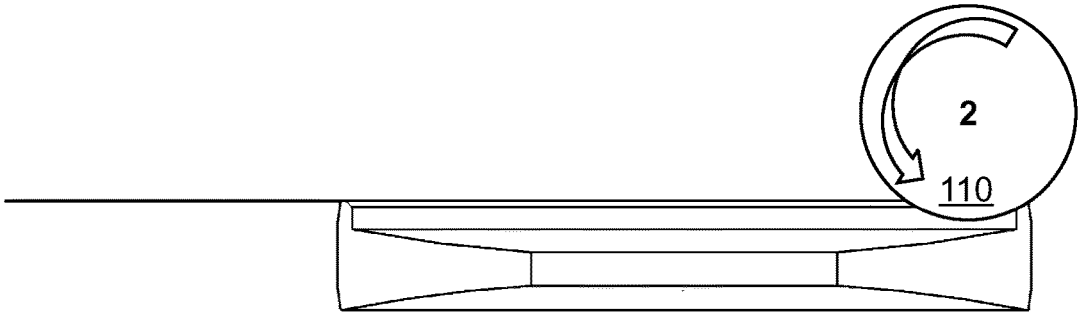
Figure 1C:
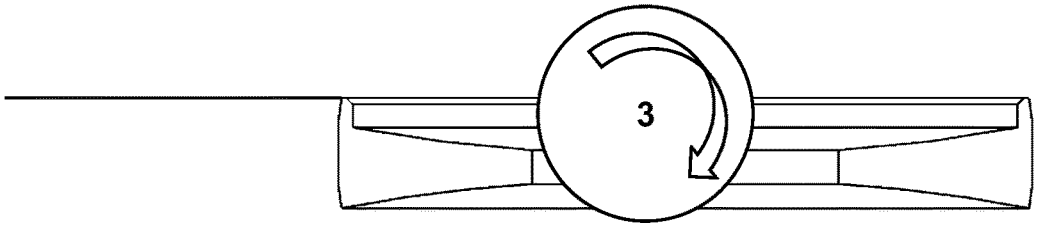
Figure 1D:
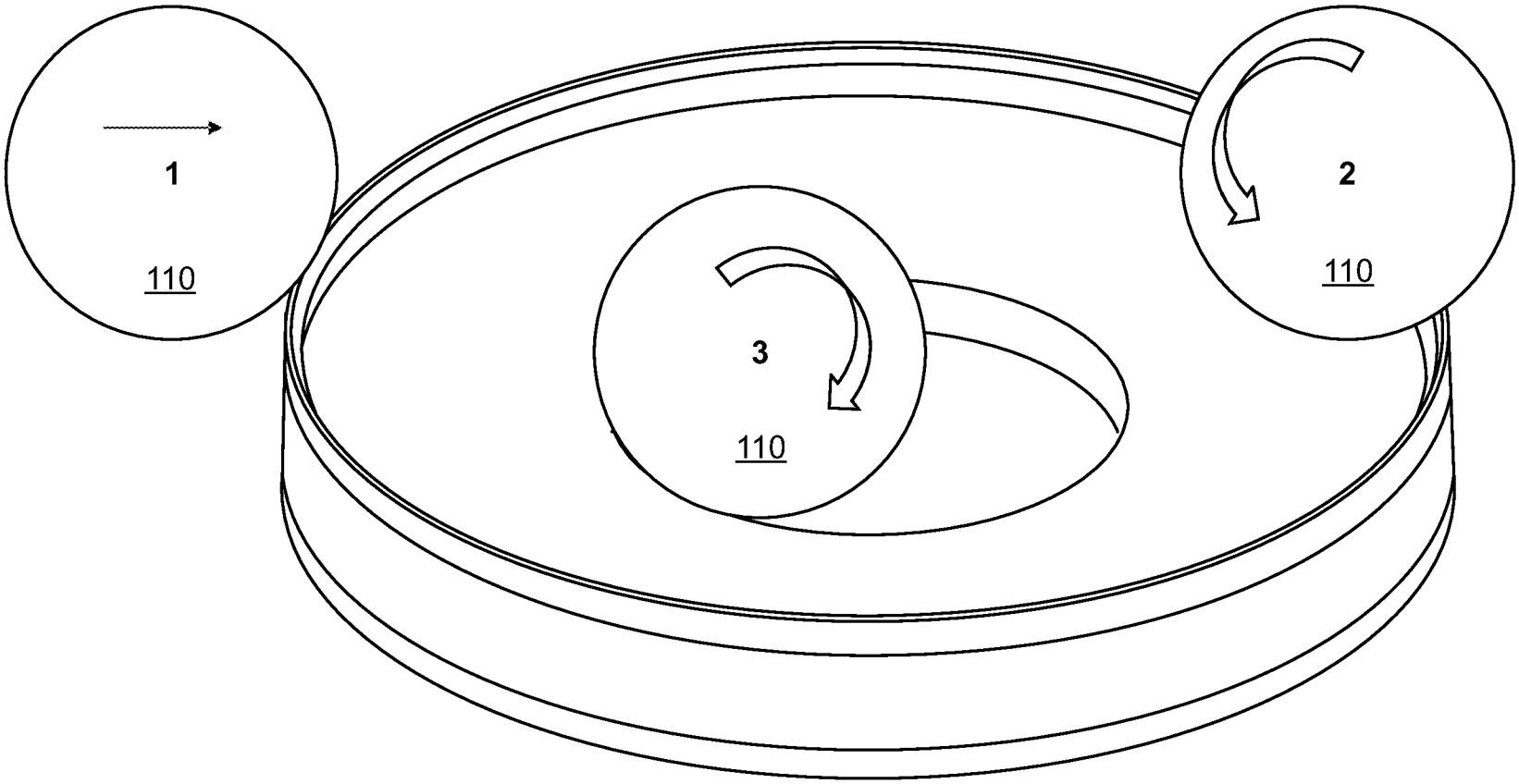
FIGS. 1D and 3A are isometric views.

Referring to FIGS. 1A, 1B, 1C, and 1D, putting training device 100 may be installed in golf hole 112 in order to provide to a golfer feedback on putting speed, to assist the golfer in training to hit putts at an optimal speed. A golfer hits golf ball 110 with a speed that (in absence of golf hole 112 or device 100) might carry ball 110 somewhat past golf hole 112 (arrow 1 of FIGS. 1A and 1D, distances d1, d2, and d3 of FIGS. 2A, 2B, and 2C). If ball 110 is on-target relative to golf hole 112, ball 110 rolls across the top of training device 100. The top surface of the training device 100 may be designed to dissipate some of the ball's energy and/or momentum and/or speed, so that if ball 110 was hit with correct speed, when ball 110 gets to the far side of training device 100 (arrow 2 of FIGS. 1B and 1D), it has not quite enough energy to continue rolling up and out of hole 112. Instead, ball 110 falls back in toward the center of training device 100. Ball 110 may then fall through a hole in the middle of the device into golf hole 112 (arrow 3 of FIGS. 1C and 1D) so that the device is clear for the next practice putt.

Conversely, a ball that is "on target" but with an above-optimal speed, rolls across and exits training device 100, providing feedback to the golfer that the speed of the putt was above its optimal speed. Similarly, a ball that is slightly "off target" to the left or the right (as much as 0.625 inches on either side of golf hole 112, so long as the center of ball 110 is still over golf hole 112), when putt at the recommended speed, will still result in a successful putt. By using the device, a putt hit either "off target" beyond the acceptable width, or "on-target but above the recommended speed" will result in a missed putt. Consistent use of the device trains the golfer to hit putts at an ideal speed that increases the effective size of the golf hole 112 and increases the probability of holing putts.

The features of device 100 may be designed to dissipate some of the ball's energy and/or momentum and/or speed, so that that after rolling across the device to the far side (arrow 2 of FIGS. 1B and 1D) of the device, a ball at the recommended speed (or slower) will not have enough energy to exit the device. Instead, ball 110 falls back in toward the center of training device 100 (arrow 3 of FIGS. 1C and 1D). This result signals feedback to the golfer that the putt was holed at the recommended speed. Conversely, if ball 110 is traveling at a speed greater than the speed recommended by the features of the device, ball 110 will exit the device and continue rolling on the putting surface, providing the golfer with visually quantifiable feedback of the amount of excess speed ball 110 carried as it entered golf hole 112.

Conventional wisdom is that an ideal putt is hit at the speed that carries ball 110 to end up about eighteen inches beyond the hole if the putt is missed. Testing has shown that for every two inches beyond the center of golf hole 112 that ball 110 travels in speed, a higher degree of accuracy is required to make a putt. Too much speed effectively decreases the diameter of the hole by about one-quarter inch per two inches of roll-through. As a result, when a putt is at a speed that would travel eighteen inches beyond golf hole 112, the effective hole size is only about 3.25 inches, much smaller than the actual 4.25 diameter of golf hole 112.

If a ball is hit so that the center of gravity is over golf hole 112, but ball 110 is going too fast, ball 110 can ride the edge of golf hole 112 and "lip out," resulting in a missed putt. The faster ball 110 moves, the more potential there is for ball 110 to miss or "lip out" if ball 110 travels near the edge of golf hole 112. The closer the putt is to ideal speed, as the golfer learns from using training device 100, the more likely those putts are to drop into golf hole 112, thus increasing the golfer's probability of making putts. When a ball is hit with the recommended speed, the effective size of golf hole 112 for a ball to drop increases to about 5.5 inches versus the standard diameter of a golf hole diameter of 4.25 inches.

Therefore, by diverging from conventional wisdom, putting at an optimal speed rather than at a speed that achieves eighteen inches of roll-through is an important technique for improving the rate of successful golf putting.

Figures 2A, 2B, 2C:
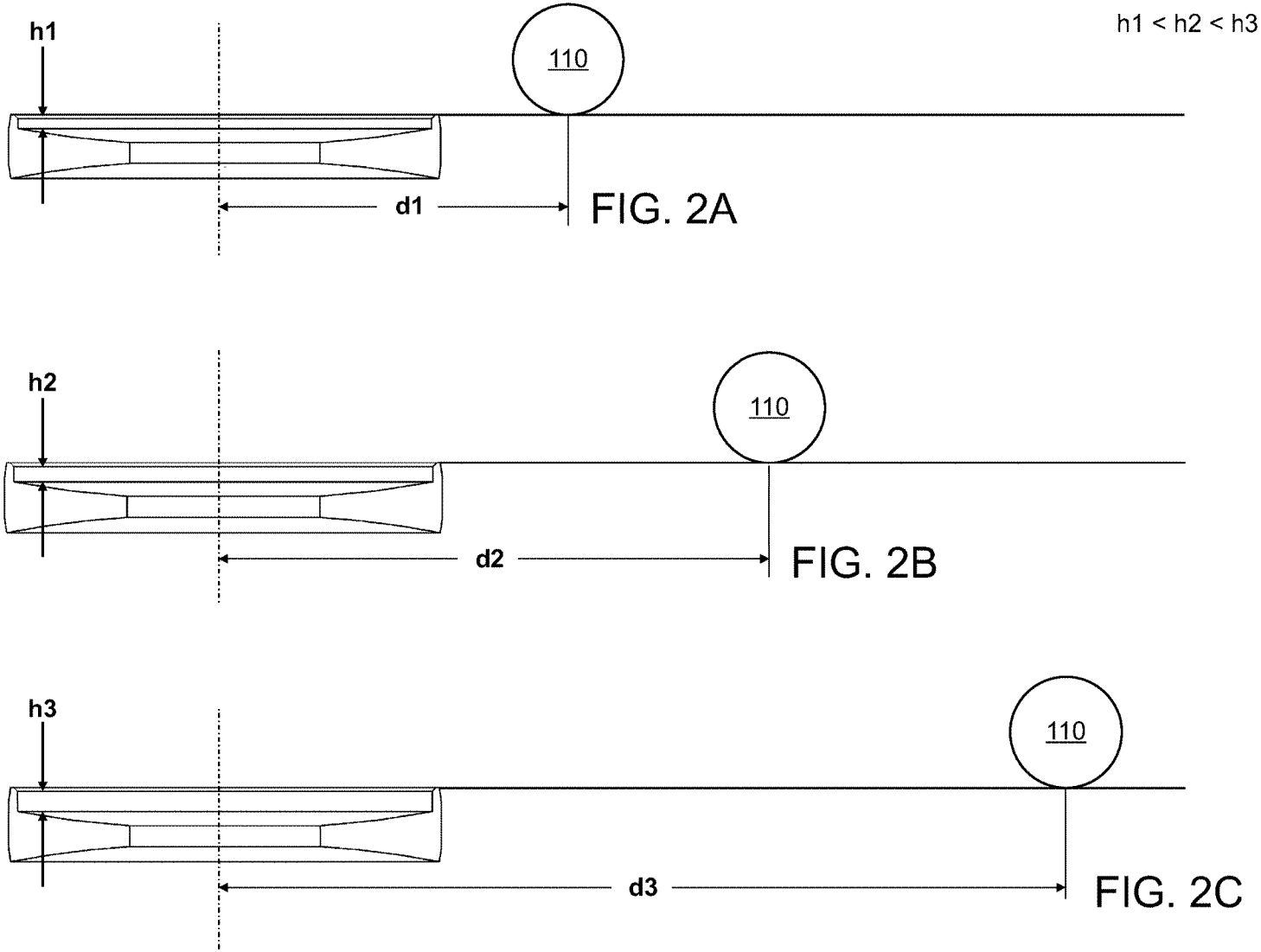

Referring to FIGS. 2A, 2B, 2C. and 2D, various parameters of training device 100 may be varied to affect the amount of energy loss, so that training device 100 may be used to train for a putt that would roll some desired distance beyond golf hole 112. For example, a shallow wall height dimension (h1 of FIG. 2A, 250 of FIG. 2D) might correlate to a relatively short roll-through distance (d1 of FIG. 2A), and a high wall height (h3 of FIG. 2C) might correlate to a relatively longer roll-through distance. If the wall height is zero (see FIG. 2E), this provides very little loss of momentum, and thus this trains the golfer to putt at a speed that is almost exactly the speed that would have near-zero roll-through, which maximizes the effective hole diameter. Wall 250 need not be vertical or a conic section or a curved surface of rotation—any shape may be used, and the shape may be chosen to impart whatever characteristic, including any desired loss of momentum and/or energy and/or speed of a golf ball rolling across the top surface, the loss corresponding to a desired loss of roll distance of a golf ball.

Figure 2D:
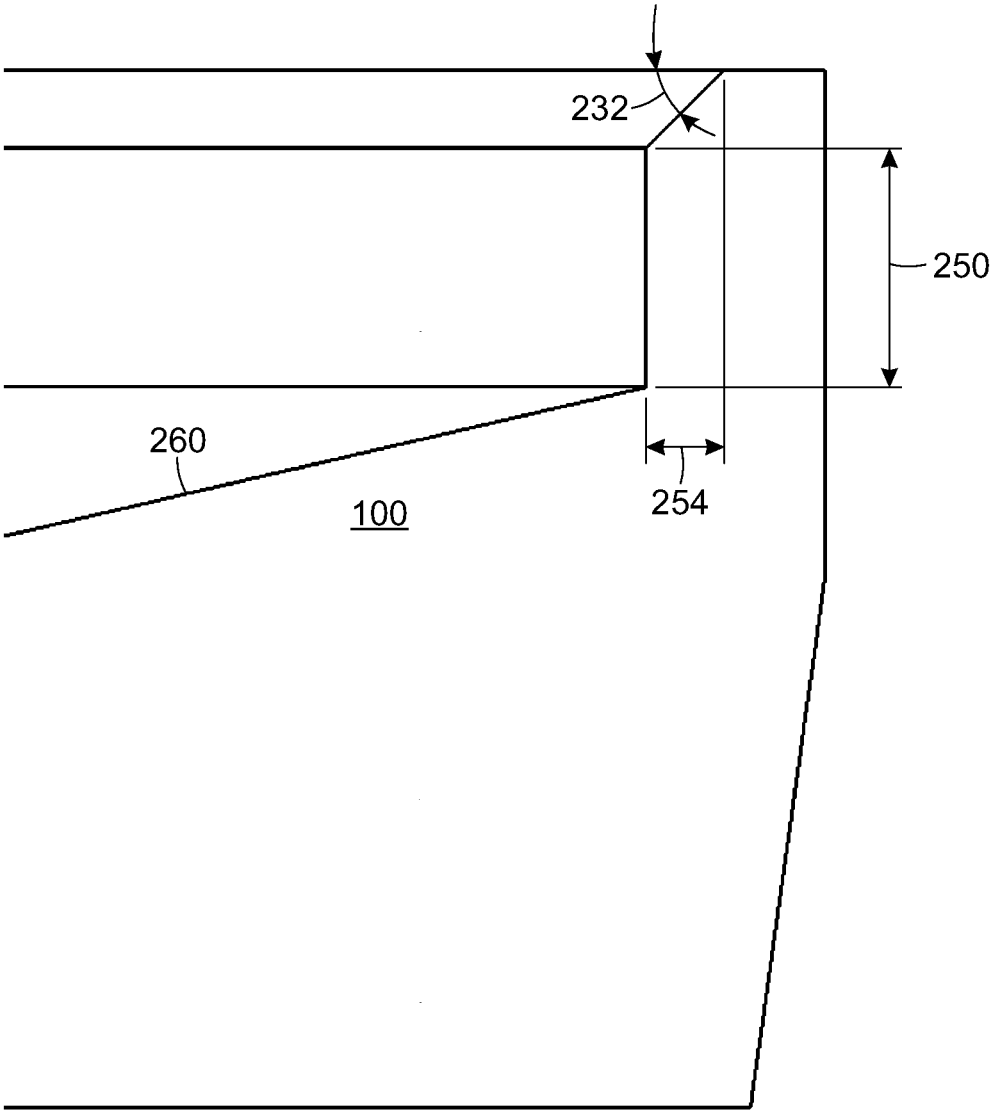
FIG. 2D is a partial side section view.

Referring to FIG. 2D, other parameters of training device 100 may be varied to affect energy/momentum loss, and therefore corresponding roll-through distance. For example, angle 252, the horizontal distance 254 of a bevel at the top edge of training device 100, or the shape of floor 260 of training device 100 may be varied. Floor 260 may be a cap of a sphere, or may be parabolic, or may be a frustum of a cone, combinations of these geometries, or others. Each shape will have different loss characteristics that may affect the corresponding roll-through distance (d1, d2, d3 of FIGS. 2A, 2B, and 2C). The shape of floor 260 may be arranged so that it always tilts toward the center, especially in cases where central hole 302 is large enough to allow the ball to fall out of the way of the next ball. In some cases, the top surface may be coated or covered with a friction or loss-inducing material or texture, to create a desired degree of energy and/or momentum and/or speed dissipation.

In some cases, there may be no wall 250 at all, and the loss function of wall 250 may be performed by installing training device in a golf hole 112, below flush with the putting surface. The more recessed and lower training device 100 is placed in golf hole 112, the more loss, and the greater roll-through that is simulated. If training device 100 is placed exactly flush with the putting surface, it provides the most difficult training configuration, where putting speed must be almost exactly the speed that would have near-zero roll-through, which maximizes the effective hole diameter.

Training devices 100 may be sold singly to train for a single roll-through distance, or may be sold in a set of two, three, four, five, or other number of devices with varying characteristics of members of the set, to allow a golfer to train for different roll-through distances. In other cases, a single training device 100 may have an adjustable rim height, or other adjustable feature that simulates different roll-through distances.

Figure 2E:
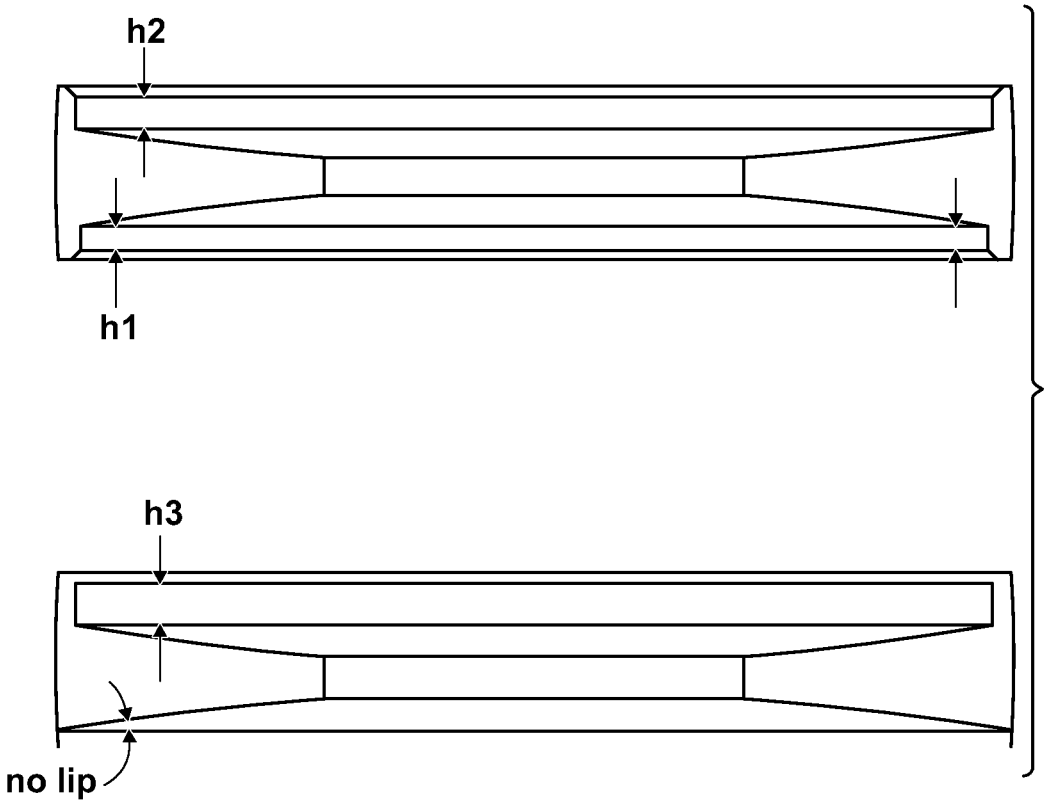

Referring to FIG. 2E, device 100 may be configured as a two-sided device, with different wall heights on the two sides. Two-sided devices 100 may be sold in a set, with a variety of wall heights, as discussed in connection with FIGS. 2A, 2B, and 2C.

Varying wall heights (and thus varying amounts of kinetic energy loss and capture ability of device 100) may be used to train a golfer to deal with varying stimp of greens. (A low stimp, for example in the range of 6 to 9, reflects a "slow" green that causes rapid dissipation of energy and speed for a rolling golf ball. A high stimp, for example in the range of 12 to 15, reflects a fast green, typically found in professional tournament courses.) A given amount of wall drop may correspond to differing roll-through differences on differently-stimped greens. For example, for a green stimped at 9, device 100 might capture a putt approximately 6¼" past the center of the hole or 4" past the back edge of the hole. For a green stimped at 11, device 100 would capture a putt that would have finished approximately 8¾" past center or 6½" past the back edge of the hole. For a green stimped at 13, device 100 would capture a putt that would have finished approximately 11¼" past center or 9" past the back edge of the hole. For a green stimped at 15, device 100 would capture a putt that would have finished approximately 13¾" past center or 11½ past the back edge of the hole.

Figure 2F:
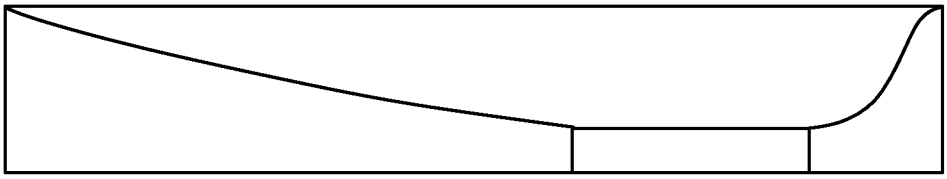

Referring to FIG. 2F, floor surface 260 may be asymmetric. Other things equal, a steeper wall on the back side of device may provide a higher loss of momentum than a device with a rotationally-symmetric top surface 260.

Figure 3A:
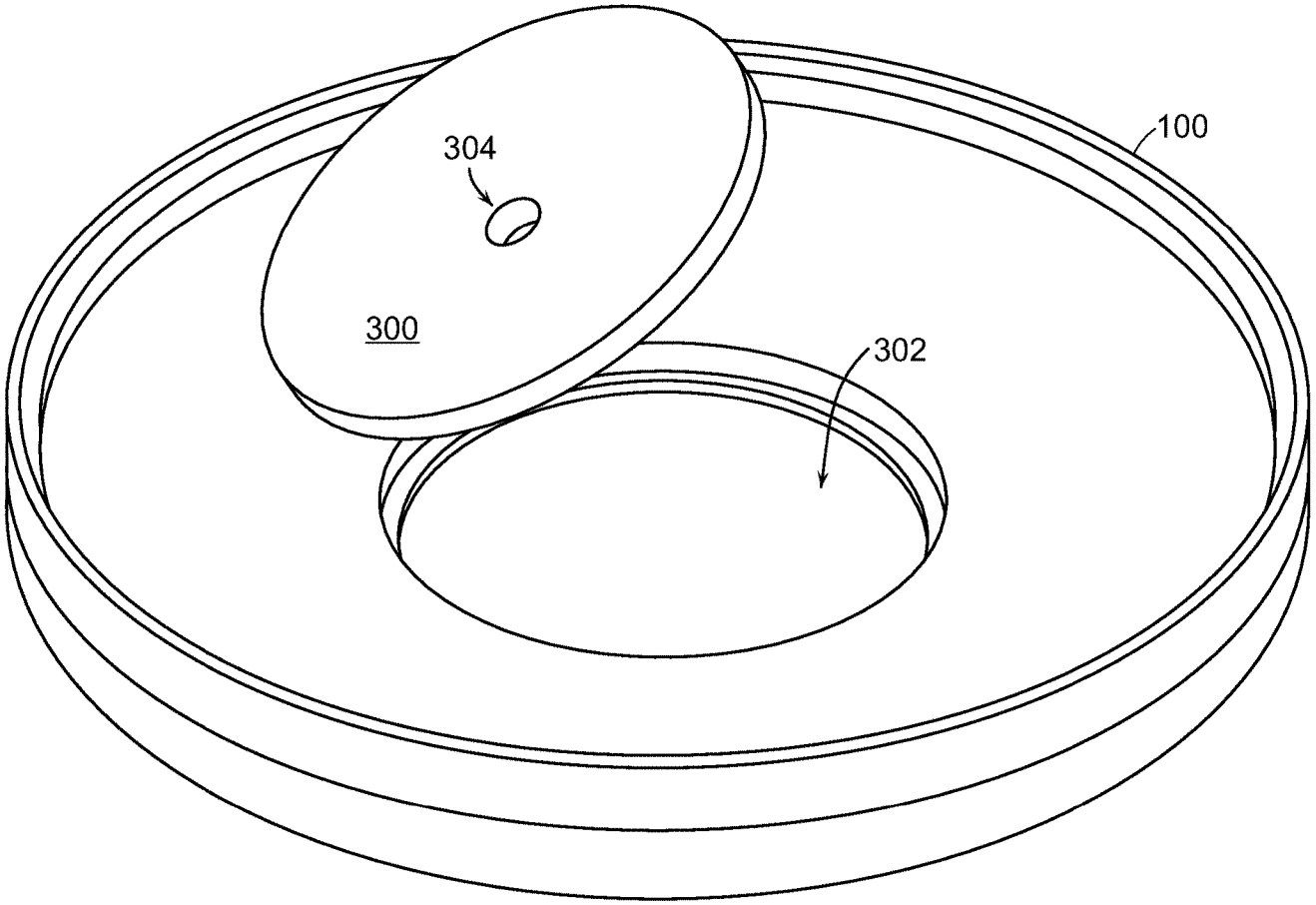
Figure 3B:
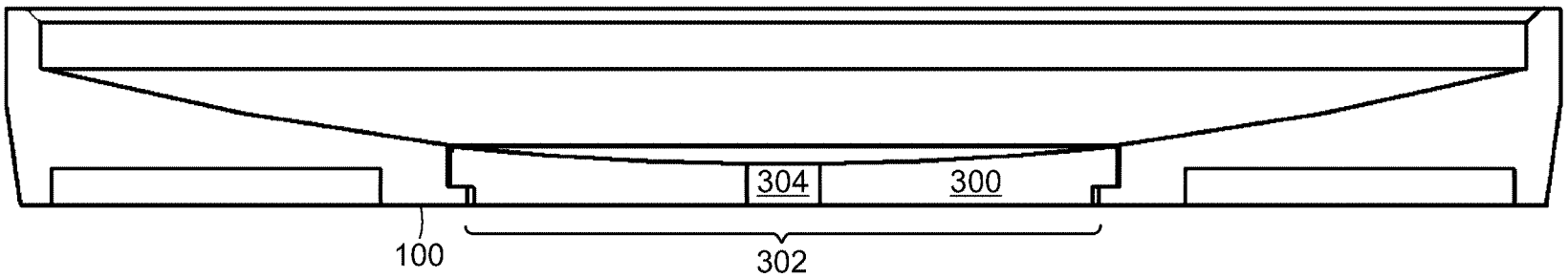

Referring to FIGS. 3A and 3B, the center of training device 100 may be formed as a cap 300 that may plug into a hole 302, or be removed. When cap 300 is removed, golf balls will fall through hole 302 either as a result of a putt hit with ideal speed, or after settling in from the far wall (arrow 3 of FIGS. 1C and 1D), so that putting exercise may continue until golf hole 112 fills with golf balls. Cap 300 may have a hole 304 to ease removal from training device 100, for example, using a golf tee. Center hole 302, 304 may be smaller than a golf ball, either with the cap in place, or simply smaller even without a cap 300. In such cases, the ball will come to rest in the center hole rather than dropping through.

In some cases, training device 100 may have spring features in the edge to clamp into golf hole 112. These spring features may be molded into the edge, for example, using multi-part molding techniques, or by assembly of multiple parts. The spring features may number two to four, or more. More retention springs may hold device 100 more stably, and reduce wear and tear on the grass at the edge of golf hole 112. In other cases, training device 100 may be just under one inch thick, so that it rests on an internally-installed golf cup (by regulation, any cup must be one inch below the putting surface). In such cases, the bottom of training device 100 may have features that can raise or elevate training device 100 above the wall of the hole. In other cases, training device 100 may have a chamfered or beveled outer diameter, to provide a press fit into golf hole 112.

Top surface 260 may have a diameter line or similar figures to assist a golfer in truing up a putt.

The undersurface of training device 100 may have ribs for stiffening. Ribs may also provide ease of handling.

For the convenience of the reader, the above description has focused on a representative sample of all possible embodiments, a sample that teaches the principles of the invention and conveys the best mode contemplated for carrying it out. Throughout this application and its associated file history, when the term "invention" is used, it refers to the entire collection of ideas and principles described; in contrast, the formal definition of the exclusive protected property right is set forth in the claims, which exclusively control. The description has not attempted to exhaustively enumerate all possible variations. Other undescribed variations or modifications may be possible. Where multiple alternative embodiments are described, in many cases it will be possible to combine elements of different embodiments, or to combine elements of the embodiments described here with other modifications or variations that are not expressly described. A list of items does not imply that any or all of the items are mutually exclusive, nor that any or all of the items are comprehensive of any category, unless expressly specified otherwise. In many cases, one feature or group of features may be used separately from the entire apparatus or methods described. Many of those undescribed variations, modifications and variations are within the literal scope of the following claims, and others are equivalent.

The invention claimed is:

1. A golf training device, comprising:

a circular body having two sides, and a rim designed to allow the training device to be inserted in a regulation golf hole and to hold the training device securely in the golf hole in both of two orientations alternatively, the first orientation having the first side uppermost and the second orientation having the second side uppermost, in either orientation, the top edge of the rim being flush with the top of the golf hole;

the first side designed to cause a first loss of momentum and/or energy and/or speed of a putted golf ball rolling across the first side, the first loss and first side designed to capture a golf ball that reaches the device rolling at or below a first speed and allow the golf ball to continue its roll across the first side if it reaches the device above the first speed, the first speed chosen for training of golfers to the first speed at which a putt should reach a golf hole, the first side designed to provide training feedback to a golfer to putt a golf ball to reach the device at or below the first speed; and a second side designed to have a second roll characteristic to permit a putted golf ball to continue its roll across the second side, the second side and second roll characteristic designed to provide training feedback to the golfer relative to speed of putts.

2. The golf training device of claim 1, wherein:

the second side is designed to cause a second loss of momentum and/or energy and/or speed of a golf ball rolling across the second side, the loss and second side designed to capture a golf ball that reaches the device rolling at or below the second speed, the second speed chosen for training golfers to a second speed at which a putt should reach a golf hole, the second loss and second speed being different from the first loss and first speed.

3. The golf training device of claim 2, further comprising:

at least one additional golf training device, having third and fourth sides, the four sides of the two golf training devices designed to cause at least three different losses of momentum and/or energy and/or speed of a golf ball rolling across, respectively corresponding to at least three different desired losses of roll distance.

4. The golf training device of claim 1, the first and second sides having circumferential walls of differing wall heights, the differing wall heights designed to cause respective differing losses of momentum and/or energy and/or speed of a golf ball rolling across.

5. The golf training device of claim 1, further comprising:

the second side being designed to have a second roll characteristic that imposes little to no loss of momentum and/or energy and/or speed of a golf ball rolling across.

6. The golf training device of claim 1, further comprising:

a hole of a diameter to allow a golf ball to drop through.

7. The golf training device of claim 1, further comprising:

a hole of a diameter corresponding to a golf tee, designed to ease removal of the golf training device from a golf hole.

8. The golf training device of claim 1, further comprising:

in the rim of the device, resilient or spring members designed to engage with a wall of a golf hole to hold the device securely in the golf hole.

9. The golf training device of claim 1, further comprising:

in the rim of the device, wedge-shaped features designed to engage with a wall of a golf hole to hold the device securely in the golf hole.

10. The golf training device of claim 1, wherein:

the first side has a circumferential wall designed to cause the loss of momentum and/or energy and/or speed of a golf ball rolling across the first side.

11. The golf training device of claim 1, wherein:

the first side is designed of a resilient but inelastic material designed to cause the loss of momentum and/or energy and/or speed of a golf ball rolling across the first side.

12. A method, comprising the steps of:

putting a golf ball across a putting surface toward a golf training device, the device designed to provide training feedback to a golfer to putt a golf ball at a desired speed, the device having:

a circular body having two sides, and a rim designed to allow the training device to be inserted in a regulation golf hole and to hold the training device securely in the golf hole in both of two orientations alternatively, the first orientation having the first side uppermost and the second orientation having the second side uppermost, in either orientation, the top edge of the rim being flush with the top of the golf hole;

the first side designed to cause a first loss of momentum and/or energy and/or speed of a putted golf ball rolling across the first side, the first loss and first side designed to capture a golf ball that reaches the device rolling at or below a first speed and allow the golf ball to continue its roll across the first side if it reaches the device above the first speed, the first speed chosen for training of golfers to the first speed at which a putt should reach a golf hole, the first side designed to provide training feedback to a golfer to putt a golf ball to reach the device at or below the first speed; and a second side designed to have a second roll characteristic to permit a putted golf ball to continue its roll across the second side, the second side and second roll characteristic designed to provide training feedback to the golfer relative to speed of putts.

13. The method of claim 12, further comprising the step of:

removing the golf training device from a recess in the putting surface, and inverting it to reveal the second side, inserting the device into the golf hole with the second side up, the upper edge of the rim flush with the top of the golf hole, and putting a golf ball across the putting surface toward the golf training device, the second side designed to provide training feedback to a golfer to putt a golf ball at a speed to reach the device at or below the second speed.

14. The method of claim 12, further comprising the step of:

removing the golf training device from a recess in the putting surface, and inserting a second golf training device, a third side of the second golf training device designed to cause loss of momentum and/or energy and/or speed of a golf ball rolling across different than the loss of rolling across the first device's first and second sides.

15. The method of claim 12, further comprising the step of:

inserting a golf tee into a hole in the device, and using the tee as a handle to remove the golf training device from a golf hole.

16. The method of claim 12, further comprising the step of:

inserting the golf training device into a golf hole, the rim of the golf training device having resilient or spring members designed to engage with a wall of the golf hole to hold the device securely in the golf hole.

17. The method of claim 12, wherein:

the first side has a circumferential wall designed to cause the loss of momentum and/or energy and/or speed of a golf ball rolling across the top surface.

18. The method of claim 12, wherein:

the top surface is designed of a resilient but inelastic material designed to cause the loss of momentum and/or energy and/or speed of a golf ball rolling across the top surface.

* * * * *